US007904015B2

(12) United States Patent
Spence et al.

(10) Patent No.: US 7,904,015 B2
(45) Date of Patent: Mar. 8, 2011

(54) CUT SHEET MEDIA HANDLING TRANSPORT

(75) Inventors: James J. Spence, Honeoye Falls, NY (US); Mark S. Amico, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 690 days.

(21) Appl. No.: 11/639,461

(22) Filed: Dec. 15, 2006

(65) Prior Publication Data

US 2008/0143042 A1 Jun. 19, 2008

(51) Int. Cl.
*B65H 5/00* (2006.01)
*B65H 5/36* (2006.01)
*G03G 15/00* (2006.01)

(52) U.S. Cl. ..... 399/365; 271/264; 271/225

(58) Field of Classification Search ..... 271/225, 271/264

See application file for complete search history.

(56) References Cited

U.S. PATENT DOCUMENTS

| | | | | |
|---|---|---|---|---|
| 5,132,712 | A | 7/1992 | Fletcher et al. | 346/159 |
| 5,457,524 | A | 10/1995 | Metcalf et al. | 355/309 |
| 5,568,246 | A | 10/1996 | Keller et al. | 355/309 |
| 5,710,968 | A | 1/1998 | Clark et al. | 399/382 |
| 5,826,157 | A | 10/1998 | Wierszewski | 399/396 |
| 5,963,770 | A | 10/1999 | Eakin | 399/364 |
| 6,286,831 | B1 * | 9/2001 | Marasco et al. | 271/303 |
| 6,466,761 | B1 | 10/2002 | Rene et al. | 399/308 |
| 6,758,471 | B2 | 7/2004 | Hirako | 271/258.01 |
| 6,775,515 | B2 | 8/2004 | Ouchi | 399/393 |
| 2005/0179198 | A1 * | 8/2005 | Biegelsen et al. | 271/303 |

FOREIGN PATENT DOCUMENTS

JP 2002251044 A * 9/2002

* cited by examiner

*Primary Examiner* — Daniel J Colilla
*Assistant Examiner* — Allister Primo
(74) *Attorney, Agent, or Firm* — Alix, Yale & Ristas, LLP

(57) ABSTRACT

A media handling transport includes first and second device halves. Each of the device halves includes first, second and third body members, with the first end portion of the second body member disposed adjacent the first end portion of the first body member, the first end portion of the third body member disposed adjacent the second end portion of the first body member, and the second end portion of the third body member disposed adjacent the second end portion of the second body member. An inner body member defines a first media transport passageway with the second body member define, a second media transport passageway with the third body member, and a third media transport passageway with the first body member. The second end portions of the second and third body members define an abutting end of the device half, with the abutting end of the first device half disposed adjacent the abutting end of the second device half in an installed transport.

4 Claims, 11 Drawing Sheets

CUT SHEET MEDIA HANDLING TRANSPORT

BACKGROUND

This disclosure relates generally to feeding cut sheet media through an electrophotographic printing machine. More particularly, the present disclosure relates to transport devices for directing the flow of cut sheet media within an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

High speed copying machines are becoming increasingly popular. These machines have a capacity or output capacity of say, for example, over 60 copies per minute. These machines are able to use single cut sheets of paper of various size such as A4, 8½×11, or 8½×14 inch copy sheets. These machines may be of the light lens, xerographic machine or may be a printer with digital input. Single, cut sheet printing machines are now available at speeds around 200 cpm.

As xerographic and other copiers increase in speed, and become more automatic, it is increasingly important to provide higher speed yet more economical, reliable and more automatic handling of both the copy sheets being made by the copier and the original document sheets being copied. It is thus desired to accommodate sheets which may vary widely in size, weight, thickness, material, condition, humidity, age, etc. These variations change the beam strength or flexural resistance, as well as, other characteristics of the sheets. Yet, the desire for automatic and high speed handling of such sheets without jams, misfeeds, uneven feeding times, or other interruptions increases the need for reliability of all sheet handling components.

Sheet inverters are one such sheet handling component with particular reliability problems and sheet handling size and capability limitations. Although a sheet inverter is referred to in the copier art as an inverter, its function is not necessary to immediately turn the sheet over (i.e., exchange one face for the other). Its function is to effectively reverse the sheet orientation in its direction of motion. That is, to reverse the lead edge and trail edge orientation of the sheet.

Typically, in an inverting device, the sheet is driven or fed by feed rollers or other suitable sheet driving mechanisms into a sheet reversing chute. By then, reversing the motion of the sheet within the chute and feeding it back out from the chute, the desired reversal of the leading and trailing edges of the sheet in the sheet path is accomplished.

Depending on the location and orientation of the inverter in a particular sheet path, this may, or may not, also accomplish the inversion (turning over) of the sheet. In some applications for example, where the (inverter) is located at a corner of a 90° to 180° inherent bend in the copier sheet path, the inverter may be used to actually prevent inverting of a sheet at that point, i.e., to maintain the same side of the sheet face-up before and after this bend in the sheet path. On the other hand, if the entry and departing path of the sheet, to and from the inverter, is in substantially the same plane, the sheet will be inverted by the inverter. While inverters have numerous applications in the handling of either original documents or copy sheets, their role is still limited to either maintaining, or reversing the sheet orientation.

SUMMARY

There is provided a media handling transport comprising first and second device halves. Each of the device halves includes first, second and third body members, each having first and second end portions. The first end portion of the second body member is disposed adjacent the first end portion of the first body member, the first end portion of the third body member is disposed adjacent the second end portion of the first body member and the second end portion of the third body member is disposed adjacent the second end portion of the second body member. An inner body member is disposed intermediate the first, second and third outer body members. The inner body member and the second body member define a first media transport passageway, the inner body member and the third body member defining a second media transport passageway, and the inner body member and the first body member defining a third media transport passageway. The second end portions of the second and third body members define an abutting end of the device half. In an installed configuration, the abutting end of the first device half is disposed adjacent the abutting end of the second device half.

The first, second and third body members each have an inner surface extending from the first end portion to the second end portion, each of the inner surfaces defines a guide having a substantially smooth uniform surface. The inner surfaces of the second and third body members each have an arcuate shape to change a direction of travel of a sheet of media substantially ninety degrees. The inner surface of the first body member has a substantially planar shape to maintain the direction of travel of a sheet of media.

The inner body member has a first guide surface extending from a lower end portion to a first upper end portion, a second guide surface extending from the lower end portion to a second upper end portion, and a third guide surface extending from the first upper end portion to the second upper end portion. The first, second and third guide surfaces are disposed opposite to the inner surfaces of the first, second and third body members, respectively and define the first, second and third media transport passageways therebetween.

Each device half further includes a first feed mechanism associated with the first end portion of the first body member and the first end portion of the second body member and a second feed mechanism associated with the second end portion of the first body member and the first end portion of the third body member.

Each device half further includes a first drive mechanism associated with the lower end portion of the inner body member and the inner surface of the second body member, a second drive mechanism associated with the lower end portion of the inner body member and the inner surface of the third body member and a third drive mechanism associated with the inner surface of the first body member and the first guide surface of the inner body member.

Each device half further includes a first diverter extending from a first end portion pivotally mounted proximate to the inner body member lower end portion to a free end disposed adjacent the abutting end of the device half, a second diverter extending from a first end portion pivotally mounted proximate to the inner body member first upper end portion to a free end disposed proximate to the first feed mechanism, and a third diverter extending from a first end portion pivotally mounted proximate to the inner body member second upper end portion to a free end disposed proximate to the second feed mechanism. Where the free end portion of each of the diverters is selectively moveable between a first diverter position or a second diverter position by a positioning device.

The media handling transport further comprises a controller in communication with the feed mechanisms, the drive mechanisms and the diverters.

The media handling transport further comprises a first baffle disposed adjacent the first feed mechanisms and a second baffle disposed adjacent the second feed mechanism.

BRIEF DESCRIPTION OF THE DRAWINGS

The present disclosure may be better understood and its numerous objects and advantages will become apparent to those skilled in the art by reference to the accompanying drawings in which.

DETAILED DESCRIPTION

Figure 1:
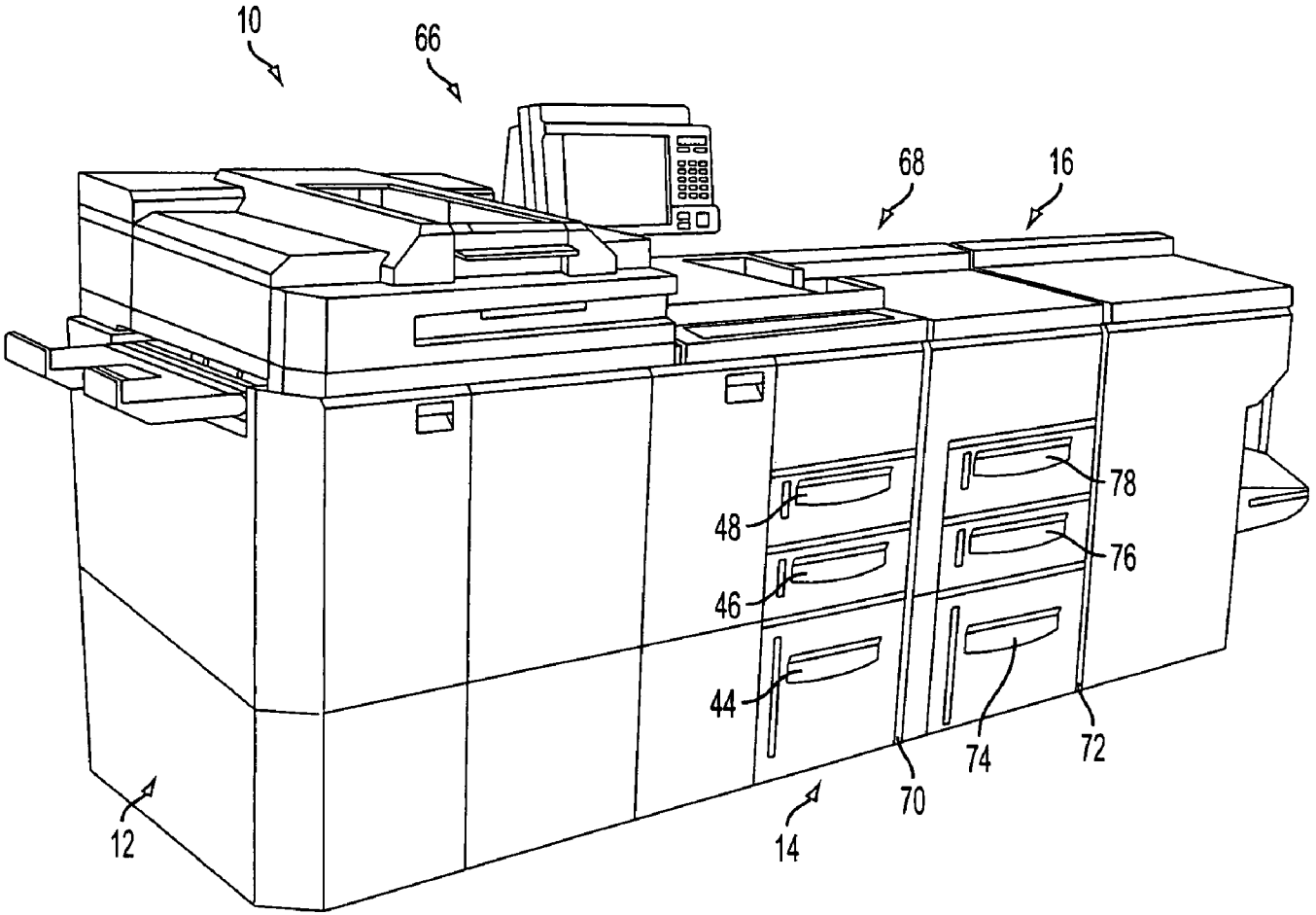
FIG. 1 PRIOR ART
FIG. 1 is a perspective view of a conventional printing machine.
Figure 2:
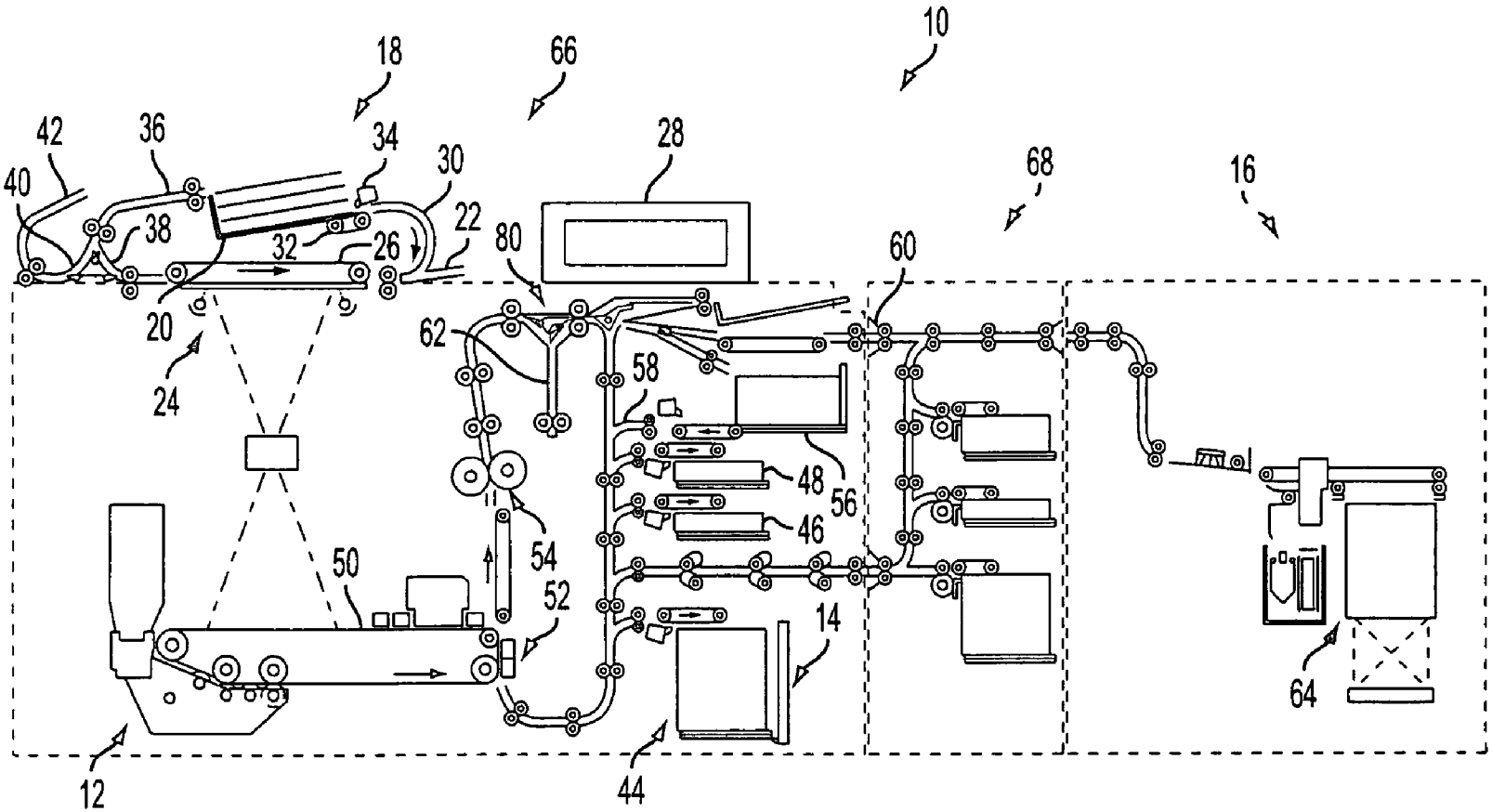
FIG. 2 PRIOR ART
FIG. 2 is a schematic view of the printing machine of FIG. 1.
Figure 2B:
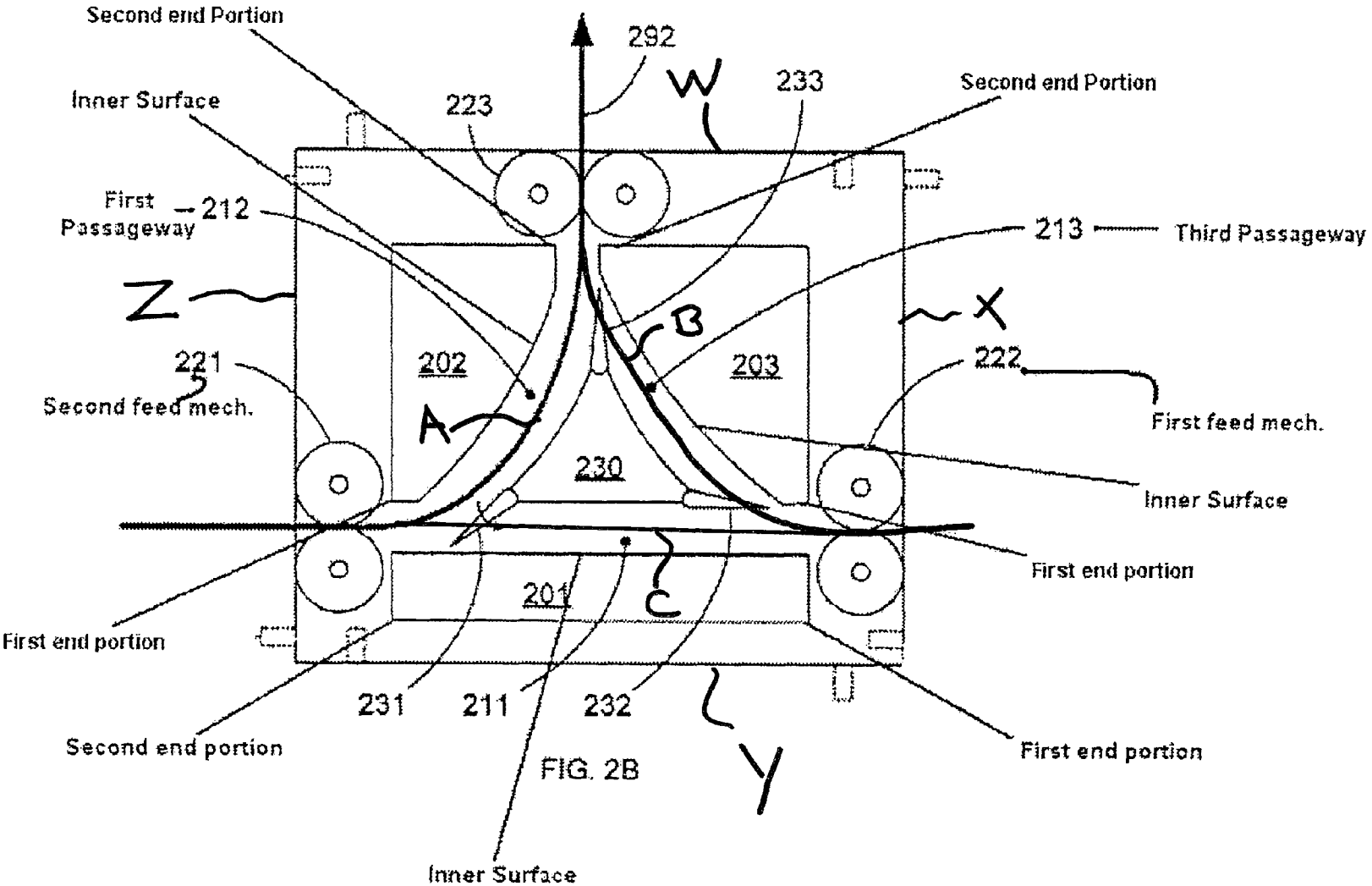
Figure 3:
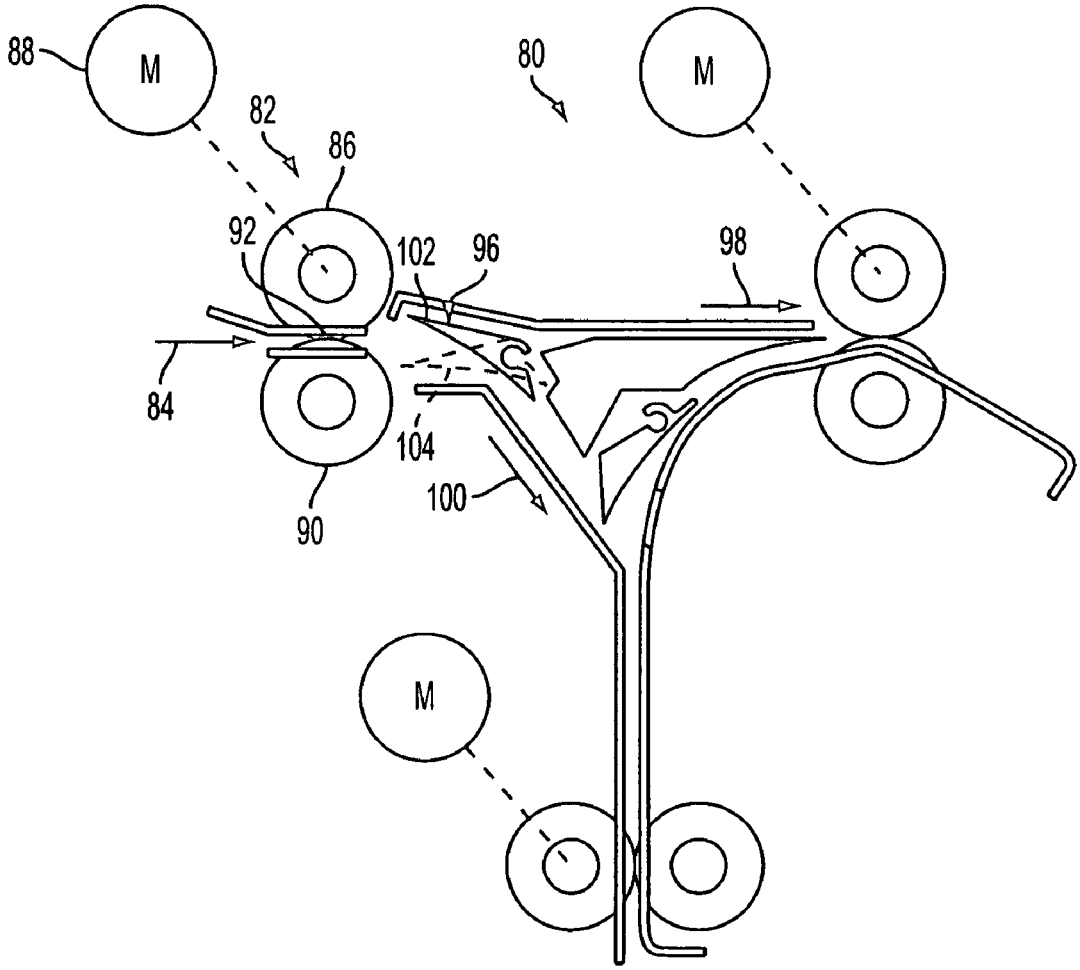
FIG. 3 PRIOR ART
FIG. 3 is a schematic view of the passive gate inverter of FIG. 2.

Inasmuch as the art of electrostatographic processing is well known, the various processing stations employed in a typical electrostatographic copying or printing machine will initially be described briefly with reference to FIGS. 1, 2 and 3.

In FIGS. 1, 2 and 3, there is shown, a conventional electrophotographic copying or printing system 10 for processing, printing and finishing print jobs. Such copying system 10 is disclosed in U.S. Pat. No. 6,186,496. For purposes of explanation, the copying system 10 is divided into a xerographic processing or printing section 12, a sheet feeding section 14, and a finishing section 16. The exemplary electrophotographic copying system 10 incorporates a recirculating document handler (RDH) 18 of a generally known type, which may be found, for example, in the well known Xerox Corporation models "1075", "5090" or "5100" duplicators. Such electrostatographic printing systems are illustrated and described in detail in various patents cited above and otherwise, including U.S. Pat. No. 4,961,092, the principal operation of which may also be disclosed in various other xerographic or other printing machines.

A printing system 10 of the type shown herein is preferably adapted to provide, in a known manner, duplex or simplex collated print sets from either duplex or simplex original documents circulated by a document handler. As is conventionally practiced, the entire document handler unit 18 may be pivotally mounted to the copier so as to be liftable by an operator for alternative manual document placement and copying. In this manner, the exemplary printing system 10 is designed to receive input documents as manually positioned on an optically transparent platen or automatically positioned thereon via a document handler, such as a recirculating document handler (RDH) 18, via a document handler input tray 20 or a document feeder slot 22.

The RDH 18 operates to automatically transport individual registered and spaced document sheets into an imaging station 24, platen operatively associated with the xerographic processing section 12. A platen transport system 26 is also provided, which may be incrementally driven via a non-slip or vacuum belt system controlled by a system controller 28 for stopping the document at a desired registration (copying) position in a manner taught by various references known in the art.

The RDH 18 has a conventional "racetrack" document loop path configuration, which preferably includes generally known inverting and non-inverting return recirculation paths for transporting original input documents back to the RDH loading and restacking tray 20. An exemplary set of duplex document sheets is shown stacked in this document tray 20. For clarity, the illustrated document and copy sheets are drawn here with exaggerated spacing between the sheets being stacked; in actual operation, these stacked sheets would be directly superposed upon one another. The RDH 18 may be a conventional dual input document handler, having an alternative semiautomatic document handling (SADH) side loading slot 22. Documents may be fed to the same imaging station 24 and transported by the same platen transport belt 26 from either the SADH input slot 22 at one side of the RDH 18, or from the regular RDH input, namely the loading or stacking tray 20, situated on top of the RDH unit. While the side loading slot 22 is referred to herein as the SADH feeding input slot, this input feeder is not limited to semi-automatic or "stream feed" document input feeding, but is also known to be usable for special "job interrupt" insert jobs. Normal RDH document feeding input comes from the bottom of the stack in tray 20 through arcuate, inverting RDH input path 30 to the upstream end of the platen transport 26. Input path 30 preferably includes a known "stack bottom" corrugated feeder-separator belt 32 and air knife 34 system including, document position sensors (not shown), and a set of turn baffles and feed rollers for inverting the incoming original documents prior to imaging.

Document inverting or non-inverting by the RDH 18 is further described, for example, in U.S. Pat. No. 4,794,429 or 4,731,637, among others. Briefly, input documents are typically exposed to a light source on the platen imaging station 24, or fed across the platen without being exposed, after which the documents may be ejected by the platen transport system 26 into downstream or off-platen rollers and further transported past a gate or a series of gates and sensors. Depending on the position of these gates, the documents are either guided directly to a document output path and then to a catch tray, or, more commonly, the documents are deflected past an additional sensor, and into an RDH return path 36. The RDH return path 36 provides a path for leading the documents back to tray 20 so that a document set can be continually recirculated. This RDH return path 36 includes reversible rollers to provide a choice of two different return paths 38 to the RDH tray: a simplex return path 38 which provides sheet or document inversion or a reversible duplex return path 40 which provides no inversion, as will be further explained. For the duplex path 40, the reversible rollers are reversed to reverse feed the previous trail edge of the sheet back into the duplex return path 40 from an inverter chute 42. This duplex return path 40 provides for the desired inversion of duplex documents in one circulation as they are returned to the tray 20, for copying opposite sides of these documents in a subsequent circulation or circulations, as described in the above cited art. Typically, the RDH inverter 42 and inversion path 40 are used only for documents loaded in the RDH input tray 20 and for duplex documents. In normal operation, a duplex document has only one inversion per circulation (occurring in the RDH input path 30). By contrast, in the simplex circulation path there are two inversions per circulation, one in each of the paths 26 and 38, whereby two inversions per circulation is equivalent to no inversion such that simplex documents are returned to tray 20 in their original (face up) orientation via the simplex path 38.

The entire stack of originals in the RDH tray 20 can be recirculated and copied to produce a plurality of collated copy sets. In addition, the document set or stack may be recirculated through the RDH any number of times in order to produce any desired number of collated duplex print sets, that is, collated sets of duplex copy sheets, in accordance with various instruction sets known as print jobs which can be programmed into a controller 28.

Since the copy or print operation and apparatus is well known and taught in numerous patents and other published art, the system will not be described in detail herein. Briefly, blank or preprinted copy sheets are conventionally provided by sheet feeder section, whereby sheets are delivered from a high capacity feeder tray 44 or from auxiliary paper trays 46 or 48 for receiving a copier document image from photo receptor 50 at transfer station 52. In addition, copy sheets can be stored and delivered to the xerographic printing section 12 via auxiliary paper trays 46 or 48 which may be provided in an independent or stand alone device coupled to the electrophotographic printing system 10. After a developed image is transferred to a copy sheet, an output copy sheet is delivered to a fuser 54, and further transported to finishing section 16 (if they are to be simplex copies), or, temporarily delivered to and stacked in a duplex buffer tray 56 if they are to be duplexed, for subsequent return (inverted) via path 58 for receiving a second side developed image in the same manner as the first side. This duplex tray 56 has a finite predetermined sheet capacity, depending on the particular copier design. The completed duplex copy is preferably transported to finishing section 16 via output path 60. An optionally operated copy path sheet inverter 62 is also provided.

All document handler, xerographic imaging sheet feeding and finishing operations are preferably controlled by a generally conventional programmable controller 28. The controller 28 preferably comprises a known programmable microprocessor system, as exemplified by the above cited and other extensive prior art (i.e., U.S. Pat. No. 4,475,156, and its references), for controlling the operation of all of the machine steps and processes described herein, including actuation of the document and copy sheet feeders and inverters, gates, etc. As further taught in the references, the controller 28 also conventionally provides a capability for storage and comparison of the numerical counts of the copy and document sheets, the number of documents fed and recirculated in a document or print set, the desired number of copy sets, and other functions which may be input into the machine by the operator through an input keyboard control or through a variety of customized graphic user interface screens. Control information and sheet path sensors (not shown) are utilized to control and keep track of the positions of the respective document and copy sheets as well as the operative components of the printing apparatus via their connection to the controller. The controller 28 may be conventionally connected to receive and act upon jam, timing, positional and other control signals from various sheet sensors in the document recirculation paths and the copy sheet paths. In addition, the controller 28 can preferably automatically actuate and regulate the positions of sheet path selection gates, including those gates associated with the dual path paper feeder, depending upon the mode of operation selected by the operator and the status of copying in that mode.

It shall be understood from the above description that multiple print jobs, once programmed, are scanned and printed and finished under the overall control of the machine controller 28. The controller 28 controls all the printer steps and functions as described herein, including imaging onto the photo receptor, paper delivery, xerographic functions associated with developing and transferring the developed image onto the paper, and collation of sets and delivery of collated sets to the binder or stitcher, as well as to the stacking device 64. The printer controller 28 typically operates by initiating a sequencing schedule which is highly efficient in monitoring the status of a series of successive print jobs to be printed and finished in a consecutive fashion. This sequencing schedule may also utilize various algorithms embodied in printer software to introduce delays for optimizing particular operations.

Adjacent printer module 66, an interposer module 68 may be utilized for storing additional sheets for use in the printing section 12 of the printer module 66 or for inserting preprinted or bland divider sheets into the stream of output from the printer module. A first module boundary 70 separates the printer module 66 from the interposer module 68. Finishing section or module 16 is positioned on the opposed side of the interposer module with a second module boundary 72 being formed between finishing section 16 and interposer module 68.

As previously mentioned, the sheet feeding section 14 includes a high capacity feed tray 44 as well as auxiliary paper trays 46 and 48. Paper within the trays 44-48 must pass through interposer module 68 on their way to the finishing section 16 thereby passing by first module boundary 70 and second module boundary 72.

Similarly, the interposer module 68 includes high capacity interposer feed tray 74, lower auxiliary interposer paper tray 76, and upper auxiliary interposer paper tray 78. The trays 74-78 serve as sources for paper to pass either directly to the finishing section 16 or to be fed to the printing section 12 of the printer module 66 and subsequently past to the finishing section 16 through interposer module 68. Paper from the interposer paper trays 74-78 may pass by first module boundary 70 as well as second module boundary 72.

Referring again to FIGS. 2 and 3, a passive gate inverter 80 is shown installed in the printing module 66. As shown in FIG. 2, the passive gate inverter 80 is positioned between fuser 54 and output path 60. The passive gate inverter 80 is utilized for guiding a sheet in a stream of sheets.

The passive gate inverting apparatus 80 includes an input feed mechanism 82 for feeding the sheets in a first direction 84. In the example, the first input feed mechanism 82 is in the form of a drive roll 86 rotated by motor 88 and a driven roll 90. The sheet is drawn in the first direction 84 at nip 92 between the drive roll 86 and the driven roll 90.

The apparatus 80 includes a diverter 96 for selectively directing the sheets to either a bypass path 98 or an inverting path 100. In the example, the diverter 96 has the form of a pivotable lever that may be positively and selectively positioned in either a first diverter position 102 or a second diverter position 104 (show in phantom). When positioned in the second position 104, the diverter 96 directs the sheets to go to bypass path 98. When the diverter is in the first position 102, the diverter 96 directs the sheets to the inverting path 100.

Figure 4:
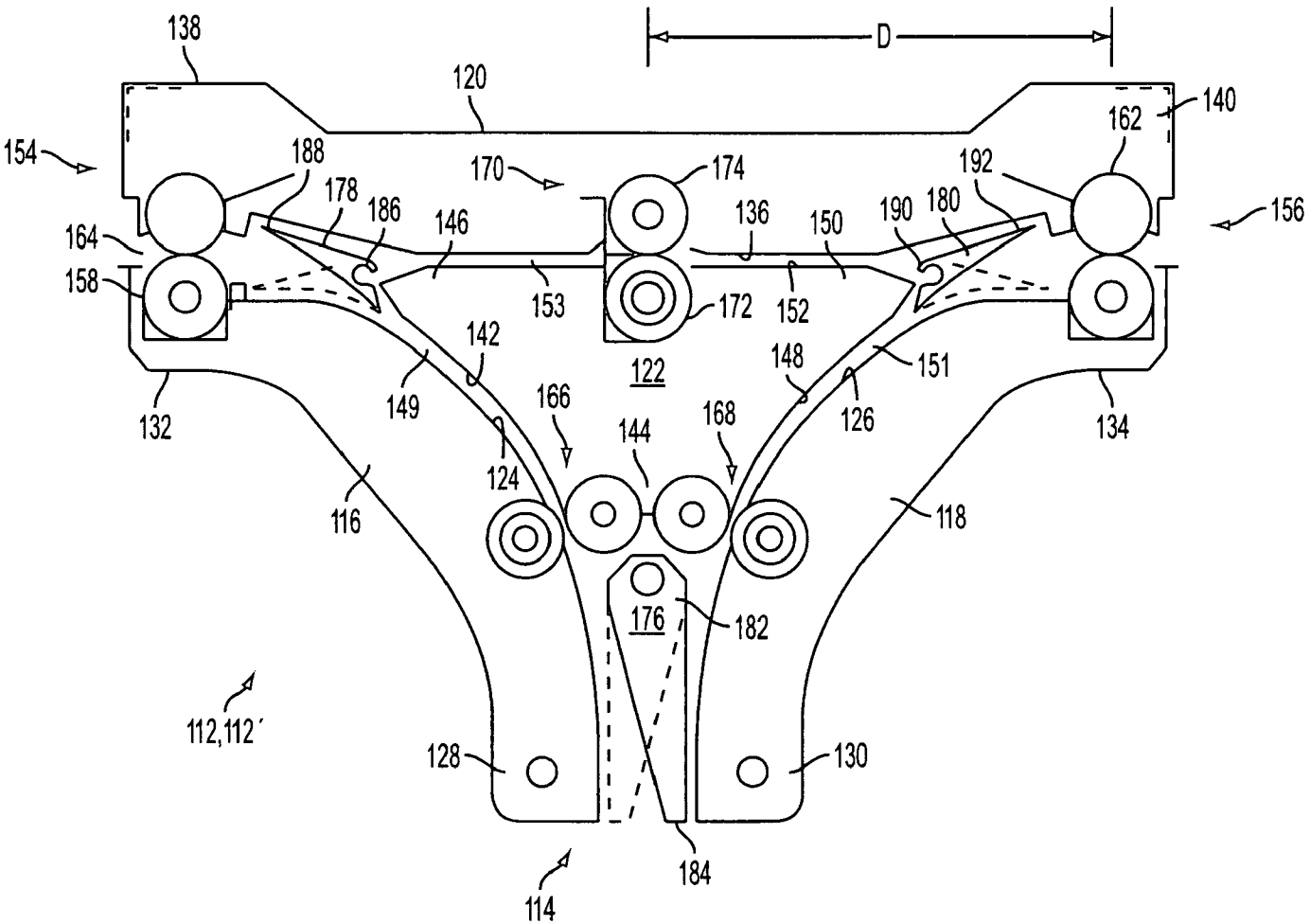
FIG. 4 is a schematic view of a media transport device half according to the present disclosure.

A media handling transport 110 in accordance with the present disclosure comprises two, substantially identical, device halves 112, 112'. As shown in FIGS. 5-8, the device halve 112, 112' are mounted together with the abutting end 114 of a first device half 112 disposed adjacent the abutting end 114 of a second device half 112'. As shown in FIG. 4, each device half 112, 112' includes three outer body members (first and second side body members 116, 118 and upper/lower body member 120), and an inner body member 122. To facilitate discussion, the device half 112, 112' will be discussed in the orientation shown in FIG. 4, although it should be understood that the media handling transport 110 may be installed in any orientation.

The first and second side body members 116, 118 are substantially identical and are made of any suitable, durable material. Each side body member 116, 118 has an inner surface 124, 126, extending from a lower or abutting end portion 128, 130 to an upper end portion 132, 134, that forms a guide having a smooth uniform surface such that a leading edge of a sheet is not stubbed or caught by a portion of the inner surface 124, 126. In the embodiment shown in FIG. 4, inner surfaces 124, 126 have an arcuate shape optimized to change the direction of travel of a sheet ninety degrees. The upper/lower body member 120 has an inner surface 136, extending horizontally from a first end portion 138 associated with the upper end portion 132 of the first side body member 116 to a second end portion 140 associated with the upper end portion 134 of the second side body member 118. Inner surface 136 also forms a guide having a smooth uniform surface such that a leading edge of a sheet is not stubbed or caught by a portion of the inner surface 136. In the embodiment shown in FIG. 4, inner surface 136 has a substantially horizontal shape optimized to maintain the direction of travel of a sheet. The inner body member 122 has a first guide surface 142 extending from a lower end portion 144 to a first upper end portion 146, a second guide surface 148 extending from the lower end portion 144 to a second upper end portion 150, and a third guide surface 152 extending horizontally from the first upper end portion 146 to the second upper end portion 150. The first, second and third guide surfaces 142, 148, 152 each have a smooth uniform surface such that a leading edge of a sheet is not stubbed or caught by a portion of the guide surface. The first, second and third guide surfaces 142, 148, 152 are disposed opposite to inner surface 124, inner surface 126 and inner surface 136, respectively, have shapes complementary thereto, and define first, second and third paper transport passageways 149, 151, 153 therebetween.

Each device half 112, 112' includes a first feed mechanism 154, associated with the upper end portion 132 of the first side body member 116 and the first end portion 138 of the upper/lower body member 120, and a second feed mechanism 156, associated with the upper end portion 134 of the second side body member 118 and the second end portion 140 of the upper/lower body member 120. The feed mechanisms 154, 156 may take the form of any feed mechanism capable of advancing the sheet. For example, the feed mechanism 154, 156 may be in the form of a drive roll 158 rotated by a motor 160 and a driven roll 162. The sheet is drawn in the direction of travel at a nip 164 between the drive roll 158 and the driven roll 162. The drive roll 158 and driven roll 162 may be rotatably mounted in the upper end portion 132, 134 of the side body member 116, 118 and the end portion 138, 140 of the upper/lower body member 120, respectively (as shown in FIG. 4). Alternatively, the drive roll 158 and driven roll 162 may be rotatably mounted in the end portion 138, 140 of the upper/lower body member 120 and the upper end portion 132, 134 of the side body member 116, 118, respectively.

Each device half 112, 112' also includes a first drive mechanism 166, associated with the lower end portion 144 of the inner body member 122 and inner surface 124, a second drive mechanism 168, associated with the lower end portion 144 of the inner body member 122 and inner surface 126, and a third drive mechanism 170, associated with inner surface 136 and guide surface 152. The drive mechanisms 166, 168. 170 may take the form of any drive mechanism capable of advancing the sheet. For example, the drive mechanism 166, 168. 170 may be in the form of a drive roll 172 rotated by a motor 160 and a driven roll 174. The sheet is drawn in the direction of travel at a nip between the drive roll 172 and the driven roll 174. The drive roll 172 and driven roll 174 may be rotatably mounted in the side body member 116, 118 and the lower end portion 144 of the inner body member 122, respectively (as shown in FIG. 4). Alternatively, the drive roll 172 and driven roll 174 may be rotatably mounted in the lower end portion 144 of the inner body member 122 and the side body member 116, 118, respectively. The distance D between either feed mechanism 154, 156 and a drive mechanism 166, 168, 170 is dictated by the minimum length of the media that will be utilized in the copying system 10. Drive motors 160 connected to the drive mechanisms 166, 168, 170 and feed mechanisms 154, 156 are controlled to advance, retract, or hold a sheet of media as directed by the controller. The controller may also control the speed of the drive motors 160.

Each device half 112, 112' further includes three diverters 176, 178, 180 for selectively directing the sheets as they pass through the media handling transport 110. Each diverter 176, 178, 180 may have any suitable configuration capable of selectively directing the sheet. In the examples shown in FIGS. 4-9, the diverters 176, 178, 180 are in the form of pivotable levers that are positively and selectively positioned in either a first diverter position or a second diverter position by a series of solenoids, cams and/or other positioning devices. The first diverter 176 is positioned below the lower end portion 144 of the inner body member 122, between the first and second side body members 116, 118. The first diverter 176 extends from a first end portion 182, pivotally mounted proximate to the lower end portion 144 of the inner body member 122, to a free end 184 disposed adjacent the abutting end 114 of the device half 112, 112'. The second diverter 178 extends from a first end portion 186, pivotally mounted proximate to the inner body member 122 first upper end portion 146, to a free end 188 disposed proximate to the first feed mechanism 154. The third diverter 180 extends from a first end portion 190, pivotally mounted proximate to the inner body member 122 second upper end portion 150, to a free end 192 disposed proximate to the second feed mechanism 156.

As described above, the media handling transport 110 is formed by mounting two device halves 112, 112' together, with the abutting end 114 of a first device half 112 disposed adjacent the abutting end 114 of a second device half 112' and the second device 112' half being a "mirror image" of the first device half 112. The lower end portions 128, 130 of the side body members 116, 118 are pivotally mounted to facilitate access to the passageways between the side body member 116, 118 and the inner body member 122 in the event of a paper jam.

The direction of sheet transport through an electrophotographic copying system 10 is easily controlled by the positioning of the three diverters 176, 178, 180 of each device half 112, 112' of the media handling transport 110.

Baffles 194 are positioned adjacent the first and second feed mechanisms 154, 156, forming a chute at the entrance/exit of each device half 112, 112'. The baffles 194 are mounted in a manner that allows for modularity to facilitate multi-use within a printer racetrack. The entry or exit angle defined by the baffles depends on the amount of media curl allowed by specification.

Figure 5:
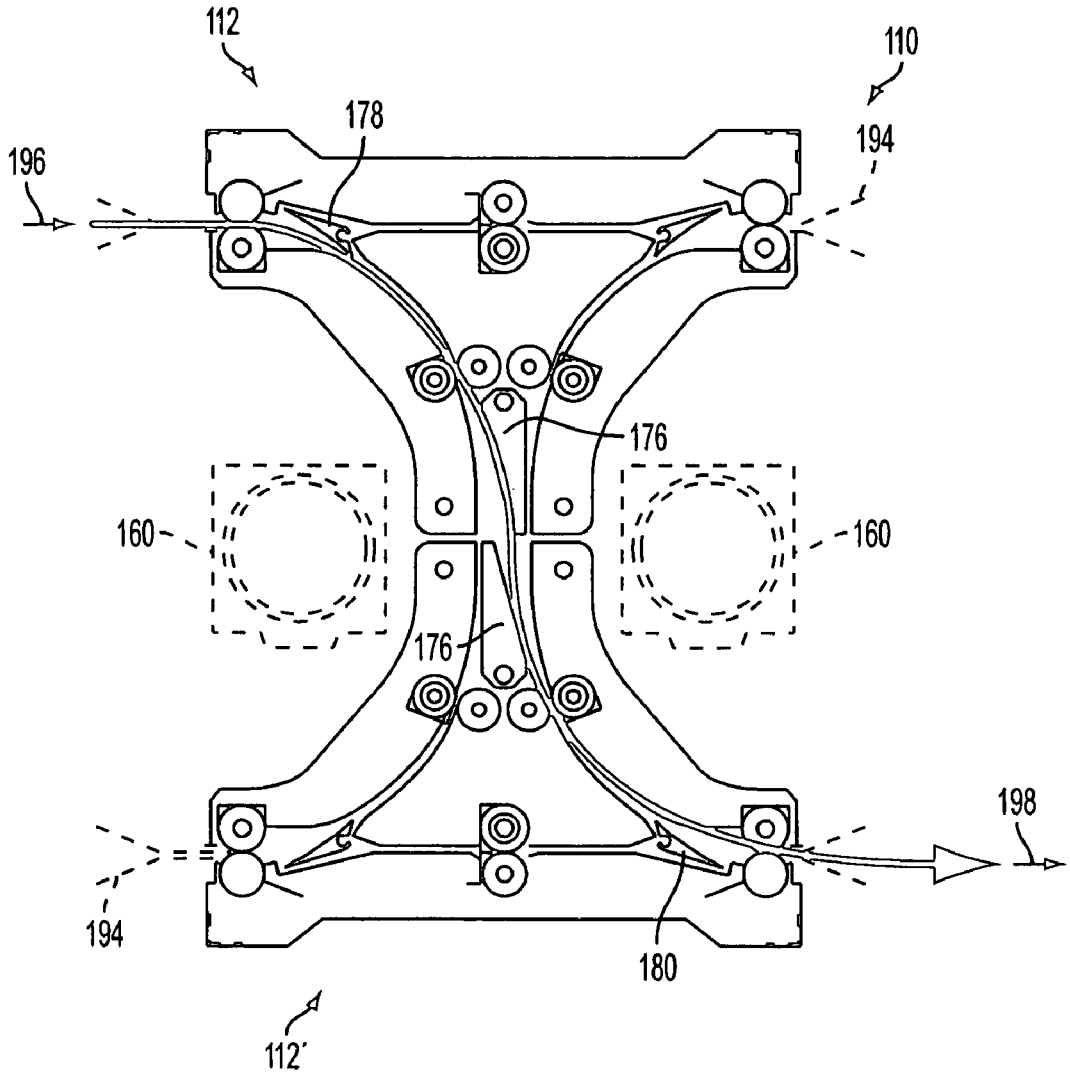
FIG. 5 is a schematic view of a media handling transport operating in a first mode of operation.
Figure 8A:
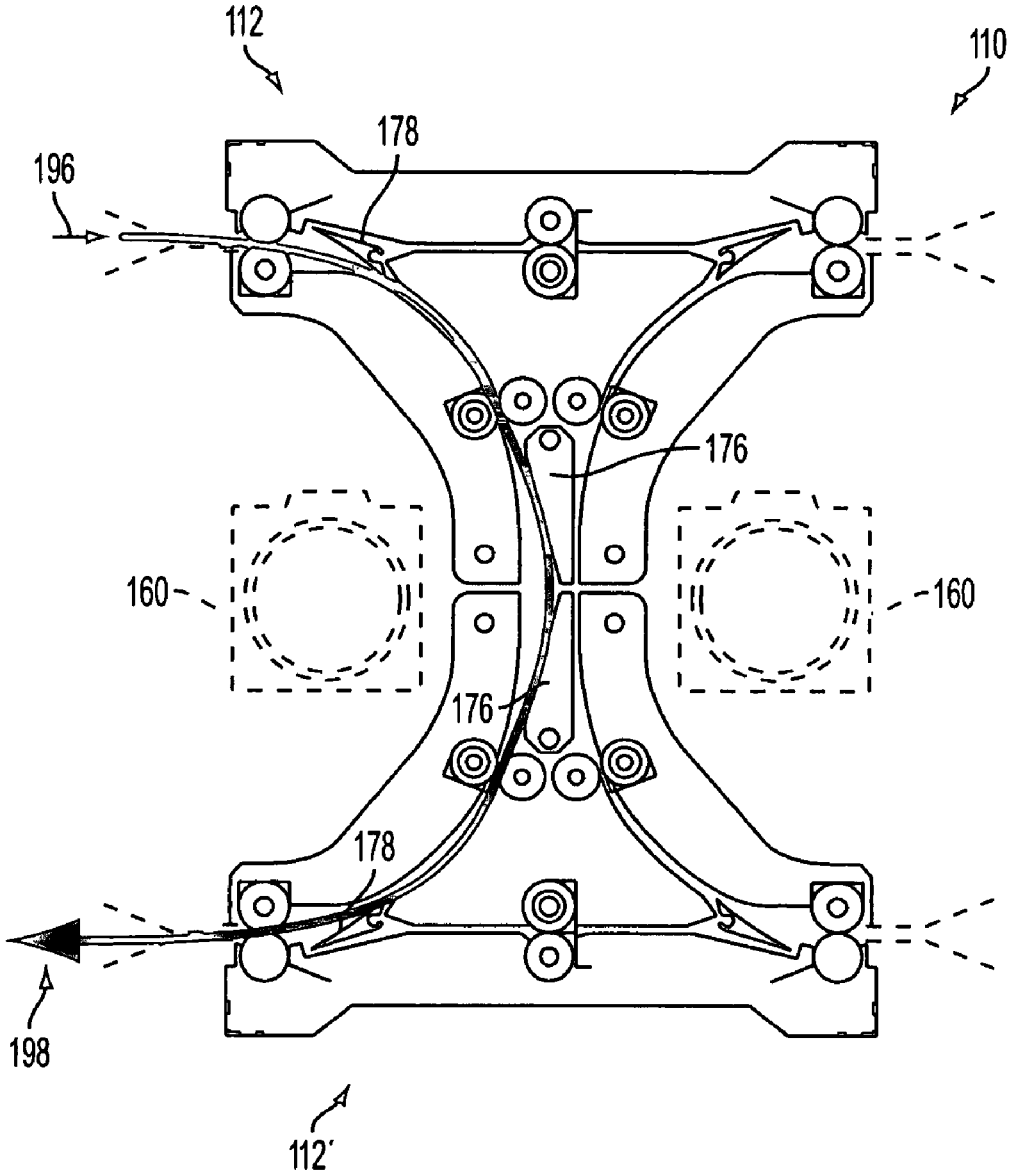
FIGS. 8A and 8B are schematic views of a media handling transport operating in a fourth mode of operation.
Figure 8B:
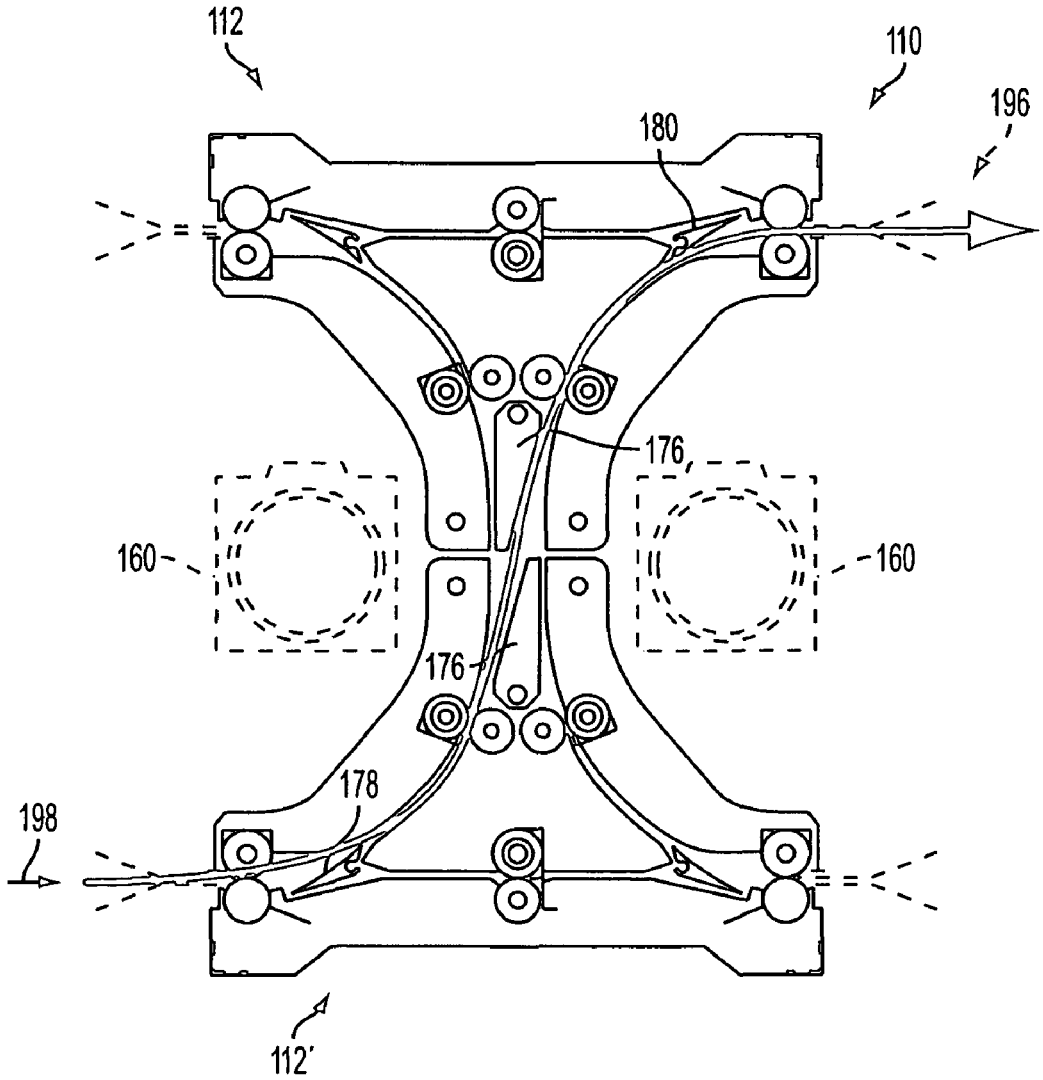
Figure 9:
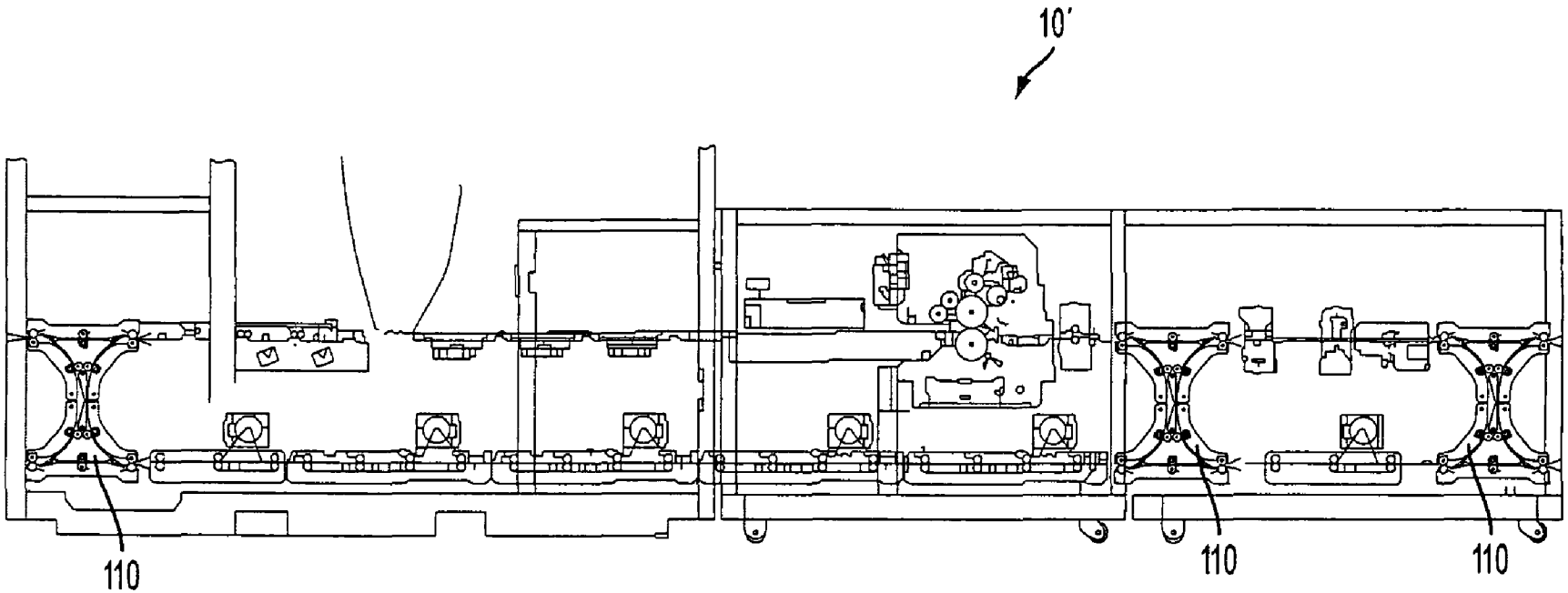
FIG. 9 is a simplified schematic view of a printing machine having the media handling transport device of FIG. 5.

FIG. 9 is a simplified schematic view of a copying system 10' having multiple media handling transport devices 110. As shown in FIGS. 5, 6, 7, 8A and 8B and described below, each media handling transport device 110 may be controlled to transport media through the copying system 10' as required for any specific job. For example, FIG. 5 illustrates the positioning of the diverters 176, 178, 180 when the media handling transport 110 is operating in a first mode of operation. In this mode of operation, the first diverter 176 of the first device half 112 is in the first diverter position (free end 184 positioned adjacent the second side body member inner surface 126, solid line FIG. 4) and the second diverter 178 of the first device half 112 is in the first diverter position (free end 188 positioned adjacent the upper/lower body member inner surface 136, solid line FIG. 4). In the mirror image second device half 112', the first diverter 176 is in the second diverter position (free end 184 positioned adjacent the first side body member inner surface 124, dotted line FIG. 4) and the third diverter 180 in the first diverter position (free end 192 positioned adjacent the upper/lower body member inner surface 136, solid line FIG. 4). As shown in FIG. 5, positioning the diverters 176, 178, 180 in this manner creates an S-shaped flow path through the media handling transport 110 that shifts sheet flow from an upper media flow path 196 to a lower media flow path 198. The positions of the third diverter 180 of the first device half 112 and the second diverter 178 of the second device half 112' are irrelevant, since neither diverter are in the media flow path.

Figure 6:
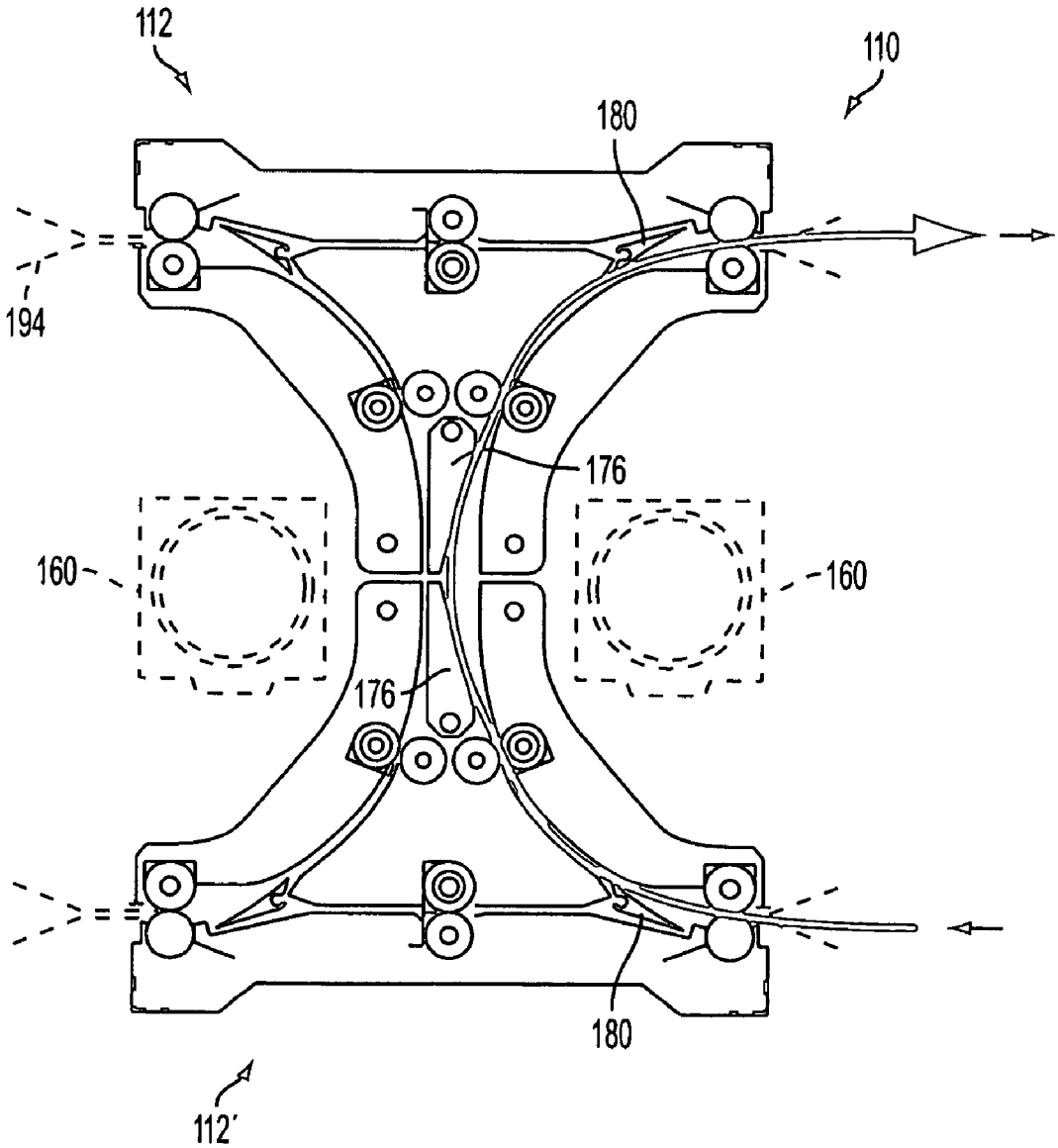
FIG. 6 is a schematic view of a media handling transport operating in a second mode of operation.

FIG. 6 illustrates the positioning of the diverters when the media handling transport 110 is operating in a second mode of operation. In this mode of operation, the first diverters 176 of both the first and second device halves 112, 112' are in the second diverter position and the third diverters 180 of both the first and second device halves 112, 112' are in the first position. Positioning the diverters 176, 180 in this manner creates a C-shaped flow path through the media handling transport 110 that reverses the direction of the media flow path and inverts the media.

Figure 7:
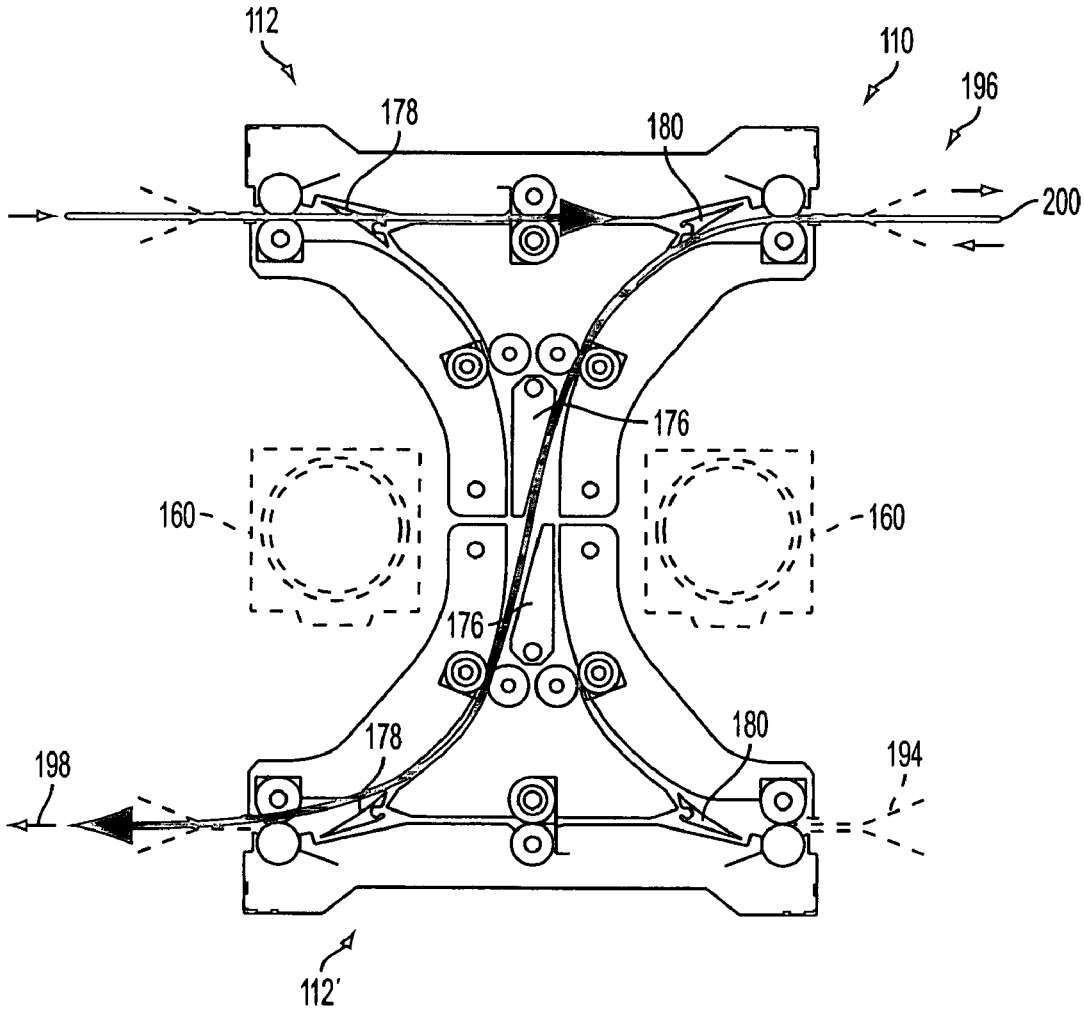
FIG. 7 is a schematic view of a media handling transport operating in a third mode of operation.

FIG. 7 illustrates the positioning of the diverters when the media handling transport is operating in a third mode of operation, where the media handling transport operates to control the flow of media in first and second horizontal directions where the second horizontal direction is opposite to the first horizontal direction. In this mode of operation, the second and third diverters 178, 180 of the first device half 112 are initially in the second diverter position. Positioning the diverters 178, 180 in this manner creates a straight flow path through the media handling transport 110. To receive the media from the return flow path 200, the third diverter 180 of the first device half 112 is shifted to the first diverter position to direct the media toward the second device half 112'. The first diverter 176 of the first device half 112 is in the second diverter position, the first diverter 176 of the second device half 112' is in the first diverter position, and the second diverter 178 of the second device half 112' is in the first diverter position. Positioning the diverters 176, 178, 180 in this manner creates an S-shaped flow path through the media handling transport 110 that shifts sheet flow from an upper media flow path 196 to a lower media flow path 198. It should be appreciated that operating in this mode of operation only requires cycling the third diverter 180 of the first device half 112 between the second and first diverter positions.

FIGS. 8A and 8B illustrate the positioning of the diverters when the media handling transport 110 is operating in a fourth mode of operation, where the media is inverted by the media handling transport 110. In this mode of operation, the second and third diverters 178, 180 of the first device half 112 and the second diverter 178 of the second device half 112' are in the first diverter position, and the first diverter 176 of the second device half 112' is in the first diverter position. As shown in FIG. 8A, the first diverter 176 of the first device half 112 is initially in the first diverter position, creating a C-shaped flow path through the media handling transport 110 that reverses the direction of the media flow path and inverts the media. Before the trailing edge of the media exits the second device half 112', the first diverter 176 of the first device half 112 is shifted to the second diverter position and the direction of travel of the media is reversed, returning the inverted media to an upper media flow path.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A media handling transport comprises:

an upper body member having an inner surface extending from a first end to a second end, a first end portion, and a second end portion;

a lower body member having an inner surface extending from a first end to a second end, a first end portion, and a second end portion;

a first side body member having an inner surface extending from a upper end to a lower end, an upper end portion, and a lower end portion, the upper end portion of the first side body member being disposed adjacent the first end portion of the upper body member and the lower end portion of the first side body member being disposed adjacent the first end portion of the lower body member;

a second side body member having an inner surface extending from a upper end to a lower end, an upper end portion, and a lower end portion, the upper end portion of the second side body member being disposed adjacent the second end portion of the upper body member and the lower end portion of the second side body member being disposed adjacent the second end portion of the lower body member;

a first inner body member having a first guide surface extending from a lower end portion to a first upper end portion, a second guide surface extending from the lower end portion to a second upper end portion, and a third guide surface extending from the first upper end portion to the second upper end portion, the first guide surface and the first side body member inner surface defining a first media transport passageway segment, the second guide surface and the second side body member inner surface defining a second media transport passageway segment, and the third guide surface and the upper body member inner surface defining a first media transport passageway;

a second inner body member having a first guide surface extending from an upper end portion to a first lower end portion, a second guide surface extending from the upper end portion to a second lower end portion, and a third guide surface extending from the first lower end portion to the second lower end portion, the first guide surface and the first side body member inner surface defining a third media transport passageway segment, the second guide surface and the second side body member inner surface defining a fourth media transport passageway segment, and the third guide surface and the lower body member inner surface defining a second media transport passageway;

a first feed mechanism including a drive roll and a driven roll, one of the drive roll or driven roll being disposed at the first end portion of the upper body member and projecting inwardly from the inner surface of the upper body member, and another of the drive roll or driven roll being disposed at the upper end portion of the first side body member and projecting inwardly from the inner surface of the first side body member;

a second feed mechanism including a drive roll and a driven roll, one of the drive roll or driven roll being disposed at the second end portion of the upper body member and projecting inwardly from the inner surface of the upper body member, and another of the drive roll or driven roll being disposed at the upper end portion of the second side body member and projecting inwardly from the inner surface of the second side body member;

a third feed mechanism including a drive roll and a driven roll, one of the drive roll or driven roll being disposed at the first end portion of the lower body member and projecting inwardly from the inner surface of the lower body member, and another of the drive roll or driven roll being disposed at the lower end portion of the first side body member and projecting inwardly from the inner surface of the first side body member;

a fourth feed mechanism including a drive roll and a driven roll, one of the drive roll or driven roll being disposed at the second end portion of the lower body member and projecting inwardly from the inner surface of the lower body member, and another of the drive roll or driven roll being disposed at the lower end portion of the second side body member and projecting inwardly from the inner surface of the second side body member;

a first diverter extending downwardly from a first end portion pivotally mounted proximate to the first inner body member lower end portion to a free end; and a second diverter extending upwardly from a first end portion pivotally mounted proximate to the second inner body member upper end portion to a free end;

wherein no portion of the first side body member is a part of the second side body member and no portion of the second side body member is a part of the first side body member, the free end portions of the first and second diverters are independently selectively moveable between a first diverter position or a second diverter position whereby a sheet of media may be directed from the first media transport passageway segment to the third media transport passageway segment, from the first media transport passageway segment to the fourth media transport passageway segment, from the third media transport passageway segment to the first media transport passageway segment, from the third media transport passageway segment to the second media transport passageway segment, from the second media transport passageway segment to the third media transport passageway segment, from the second media transport passageway segment to the fourth media transport passageway segment, from the fourth media transport passageway segment to the first media transport passageway segment, or from the fourth media transport passageway segment to the second media transport passageway segment.

2. The media handling transport of claim 1 further comprising:

a first drive mechanism associated with the first media transport passageway;

a second drive mechanism associated with the second media transport passageway;

a third drive mechanism associated with the first media transport passageway segment;

a fourth drive mechanism associated with the second media transport passageway segment;

a fifth drive mechanism associated with the third media transport passageway segment; and a sixth drive mechanism associated with the fourth media transport passageway segment.

3. The media handling transport of claim 2 further comprising:

a third diverter disposed intermediate the first inner body member first upper end portion, the upper body member, and the first side body member;

a fourth diverter disposed intermediate the first inner body member second upper end portion, the upper body member, and the second side body member;

a fifth diverter disposed intermediate the second inner body member first lower end portion, the lower body member, and the first side body member; and a sixth diverter disposed intermediate the second inner body member second lower end portion, the lower body member, and the second side body member.

4. An electrophotographic printing machine comprising:

at least one print engine;

an input media path delivering a print media to the print engine;

an output media path removing the print media from the print engine; and a media handling transport disposed in at least one of the media paths, the media handling transport including an upper body member having an inner surface extending from a first end to a second end, a first end portion, and a second end portion;

a lower body member having an inner surface extending from a first end to a second end, a first end portion, and a second end portion;

a first side body member having an inner surface extending from a upper end to a lower end, an upper end portion, and a lower end portion, the upper end portion of the first side body member being disposed adjacent the first end portion of the upper body member and the lower end portion of the first side body member being disposed adjacent the first end portion of the lower body member;

a second side body member having an inner surface extending from a upper end to a lower end, an upper end portion, and a lower end portion, the upper end portion of the second side body member being disposed adjacent the second end portion of the upper body member and the lower end portion of the second side body member being disposed adjacent the second end portion of the lower body member;

a first inner body member having a first guide surface extending from a lower end portion to a first upper end portion, a second guide surface extending from the lower end portion to a second upper end portion, and a third guide surface extending from the first upper end portion to the second upper end portion, the first guide surface and the first side body member inner surface defining a first media transport passageway segment, the second guide surface and the second side body member inner surface defining a second media transport passageway segment, and the third guide surface and the upper body member inner surface defining a first media transport passageway;

a second inner body member having a first guide surface extending from an upper end portion to a first lower end portion, a second guide surface extending from the upper end portion to a second lower end portion, and a third guide surface extending from the first lower end portion to the second lower end portion, the first guide surface and the first side body member inner surface defining a third media transport passageway segment, the second guide surface and the second side body member inner surface defining a fourth media transport passageway segment, and the third guide surface and the lower body member inner surface defining a second media transport passageway;

a first feed mechanism including a drive roll and a driven roll, one of the drive roll or driven roll being disposed at the first end portion of the upper body member and projecting inwardly from the inner surface of the upper body member, and another of the drive roll or driven roll being disposed at the upper end portion of the first side body member and projecting inwardly from the inner surface of the first side body member;

a second feed mechanism including a drive roll and a driven roll, one of the drive roll or driven roll being disposed at the second end portion of the upper body member and projecting inwardly from the inner surface of the upper body member, and another of the drive roll or driven roll being disposed at the upper end portion of the second side body member and projecting inwardly from the inner surface of the second side body member;

a third feed mechanism including a drive roll and a driven roll, one of the drive roll or driven roll being disposed at the first end portion of the lower body member and projecting inwardly from the inner surface of the lower body member, and another of the drive roll or driven roll being disposed at the lower end portion of the first side body member and projecting inwardly from the inner surface of the first side body member;

a fourth feed mechanism including a drive roll and a driven roll, one of the drive roll or driven roll being disposed at the second end portion of the lower body member and projecting inwardly from the inner surface of the lower body member, and another of the drive roll or driven roll being disposed at the lower end portion of the second side body member and projecting inwardly from the inner surface of the second side body member;

a first diverter extending downwardly from a first end portion pivotally mounted proximate to the first inner body member lower end portion to a free end; and a second diverter extending upwardly from a first end portion pivotally mounted proximate to the second inner body member upper end portion to a free end, wherein no portion of the first side body member is a part of the second side body member and no portion of the second side body member is a part of the first side body member, the free end portions of the first and second diverters are independently selectively moveable between a first diverter position or a second diverter position whereby a sheet of media may be directed from the first media transport passageway segment to the third media transport passageway segment, from the first media transport passageway segment to the fourth media transport passageway segment, from the third media transport passageway segment to the first media transport passageway segment, from the third media transport passageway segment to the second media transport passageway segment, from the second media transport passageway segment to the third media transport passageway segment, from the second media transport passageway segment to the fourth media transport passageway segment, from the fourth media transport passageway segment to the first media transport passageway segment, or from the fourth media transport passageway segment to the second media transport passageway segment.

* * * * *